United States Patent [19]

Holt

[11] Patent Number: 4,872,218

[45] Date of Patent: Oct. 10, 1989

[54] CAP ATTACHMENT TO PREVENT PROTRUDING HAIR

[76] Inventor: George G. Holt, P.O. Box 3244, Morristown, Tenn. 37814

[21] Appl. No.: 161,747

[22] Filed: Feb. 29, 1988

[51] Int. Cl.[4] ..... A42B 1/22; A42B 1/24

[52] U.S. Cl. ..... 2/171.5; 2/197; 2/199

[58] Field of Search ..... 2/197, 199, 195, 12, 2/171.5, 171.4

[56] References Cited

U.S. PATENT DOCUMENTS

| | | | |
|---|---|---|---|
| 740,330 | 9/1903 | Stirewalt | 2/171.5 |
| 1,156,980 | 10/1915 | Coppers | 2/197 |
| 1,652,145 | 12/1927 | Lipschutz | 2/197 |
| 2,106,570 | 1/1938 | Lipton | 2/197 |
| 2,106,571 | 1/1938 | Lipton | 2/171.5 |
| 2,859,448 | 11/1958 | Gaichel | 2/199 |
| 2,869,134 | 1/1959 | Milstein | 2/197 X |
| 4,023,212 | 5/1977 | Huffman | 2/197 |
| 4,630,317 | 12/1986 | Brown et al. | 2/199 X |

*Primary Examiner*—Peter Nerbun

*Attorney, Agent, or Firm*—Pitts and Brittian

[57] ABSTRACT

A hair constraint attachment for a cap (12) having an opening in the back of the head cover (12). The attachment (10) includes an attachment member (30) which is dimensioned for covering the opening (26) normally defined between an adjustable strap (14) and the head cover (18). The attachment member (30) is secured to the cap such that the attachment member (30) covers the opening (26) and prevents hair from protruding therethrough when the cap (12) is worn.

7 Claims, 2 Drawing Sheets

FIG. 1
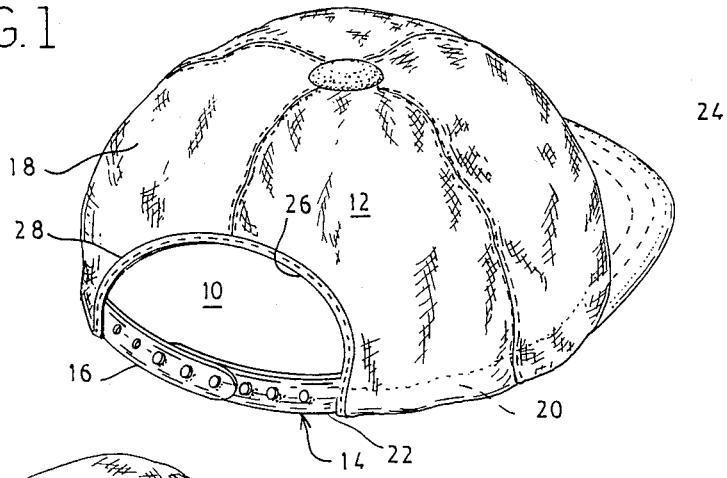
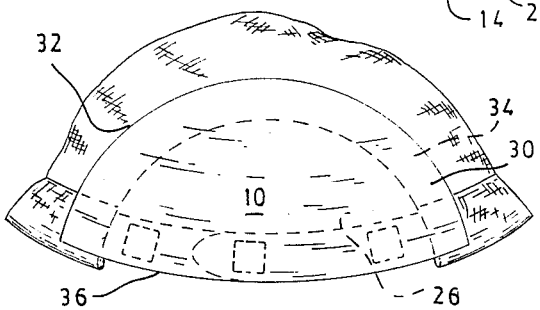
FIG. 2
FIG. 3
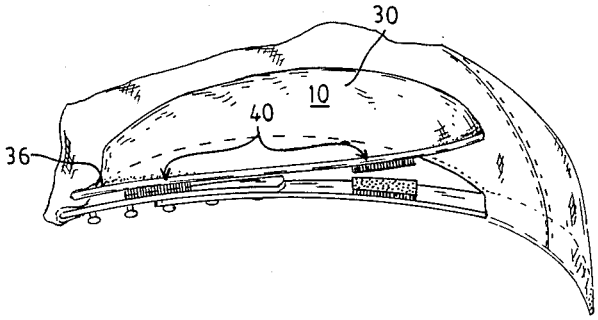

CAP ATTACHMENT TO PREVENT PROTRUDING HAIR

DESCRIPTION

1. Technical Field

This invention relates to caps of the type which have adjustable head bands. Such caps normally define an opening in the head cover portion of the cap through which hair protrudes when the cap is worn. The present invention is designed to provide a cover for such opening to give the cap and wearer a neater appearance.

2. Background Art

Caps which have adjustable headbands normally define an opening bordered by an off set portion of the head cover and an adjustable strap which is used to adjust the effective circumference of the cap head band. When such cap is worn, it is common for hair to protrude through this opening creating what is commonly referred to as a "rooster tail". This "rooster tail" is distractive and a common source of embarrassment when the cap is worn and after the cap is removed from the wearer's head if the rooster tail has been formed into the wearer's hair.

Accordingly, it is an object of the present invention to provide an attachment for a cap having an opening in the back of the head cover which includes an attachment member dimensioned for covering the opening to assist in preventing hair from protruding therethrough when the cap is worn.

It is another object of the present invention to provide such an attachment member which can be readily mounted on the cap and which is positioned proximate the inner surface of the cap cover.

Another object of the present invention is to provide such an attachment for a cap which can be readily and inexpensively manufactured.

DISCLOSURE OF THE INVENTION

Other objects and advantages will be accomplished by the present invention which provides a hair constraint attachment for a cap having an opening in the back of the head cover. The attachment is designed for covering the opening normally defined between the head cover and an adjustable strap which serves to provide a universal fit feature for the head band. The attachment includes an attachment member which is dimensioned for covering the opening. The attachment member is releasably secured to the cap, and preferably to the adjustable strap of the cap in a manner which prevents hair from protruding through the opening when the cap is worn.

BRIEF DESCRIPTION OF THE DRAWINGS

The above-mentioned features of the invention will become more clearly understood from the following detailed description read together with the drawings in which:

FIG. 1 illustrates a perspective view of a cap having an attachment constructed in accordance with various features of the present invention mounted thereon to prevent hair from protruding through the opening in the rear of the head cover.

FIG. 2 is a view of the attachment shown in FIG. 1 as seen from the inside of the cap cover with a portion of the cap broken away for illustrative purposes.

FIG. 3 illustrates one embodiment of means for mounting the attachment on the cap which comprise Velcro fasteners.

BEST MODE FOR CARRYING OUT THE INVENTION

Figure 4:
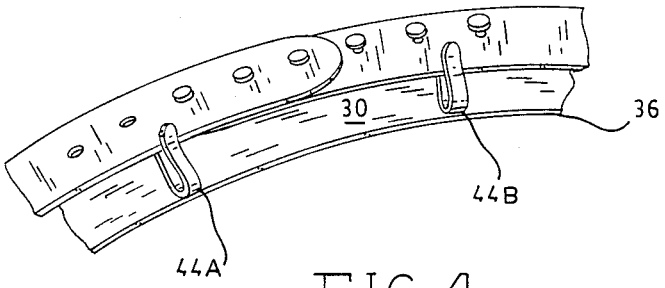
FIG. 4 illustrates an alternate embodiment of means for mounting the attachment on a cap which comprises clips joined with the attachment and designed for receiving the adjustable strap.

A hair constraint attachment is generally indicated at 10 in the figures. The attachment 10 is designed for fitting onto caps such as cap 12 which includes a size adjustment strap 14. Such size adjustment straps are commonly used with various types of caps, and a baseball type cap is shown in FIG. 1 as an example of the type of cap upon which the hair constraint attachment 10 can be secured. Further, a post and opening type size adjustment strap 14 is shown in the figures. These types of straps 14 generally include a first member 16 having one end portion which is secured to the lower border of the head cover 18 proximate the head band 20. This first member 16 normally carries a plurality of posts as illustrated in FIGS. 1 and 3 each of which extend outwardly from the first member 16 and include a distal end portion of increased dimension. These posts are received in registering openings defined in the cooperating member 22 which is secured to the lower border of the head cover 18 proximate the head band 20. These posts and openings type size adjustment straps come in various dimensions. It will also be recognized by those skilled in the art that size adjustment straps which comprise belts are often used on certain types of caps. Further, the caps may or may not include visors of the type illustrated at 24 in FIG. 1.

An opening 26 is defined in the back of the head cover 18. This opening 26 assists in preventing the back of the head cover 18 from bunching as the effective length of the size adjustment strap is changed. It will be noted that the opening 26 is bordered by the head cover 18 which is usually provided with a binding 28 and the size adjustment strap 14. Thus, the opening 26 is defined between the head cover 18 and the size adjustment strap 14 at the back of the head cover 18.

When caps of the type shown in FIG. 1 are worn, hair normally protrudes through the opening 26. It is not uncommon for such hair to be bent and shaped in the form of a "rooster tail". The hair constraint attachment 10 includes an attachment member 30 which is dimensioned for covering the opening 26 to assist in preventing hair from protruding therethrough when the cap is worn. It will be noted in FIG. 1, that the opening 26 is substantially semi-circular. Accordingly, the attachment member 30 is provided with a similar geometry such that its curved edge 32 overlays the perimeter 34 of the head cover 18 which defines the opening 26. The lower edge 36 of the attachment member 30 is substantially planar, or can be provided with a slight curve to follow the outline of the lower border of the hat when the attachment member is folded to the contour of the head.

The attachment member 30 is preferably fabricated from a thin film plastic sheet. It can be colored, and is preferably transparent, having a thickness of approximately 0.010 mil in the preferred embodiment. It is designed to fit the contour of the hair when the cap is put on without bending backwards or causing discomfort to the wearer.

Securing means are provided for mounting the attachment member 30 on the cap 10 such that the attachment member 30 covers the opening 26 and prevents hair from protruding through this opening when the cap is worn. In one embodiment, the securing means 40 comprises Velcro hook and pile fasteners which serve to mount the attachment member 30 on the cap 10, or more specifically, on the size adjustment strap 14 (see FIG. 3). In the embodiment depicted in FIG. 3, the Velcro fasteners are mounted, as shown, at spaced locations along the lower perimeter of the attachment member 30 proximate the lower edge 36. Cooperating fasteners portions are mounted at similarly spaced locations on the size adjustment strap 14 as depicted. Double-backed tape can be used to mount the Velcro fasteners onto the attachment member 30 and the size adjustment strap 14. It will, of course, be recognized that other suitable adhesive means can be used. However, it is also envisioned that the attachment member 30 can be manufactured with the Velcro fasteners mounted thereon to facilitate application to a cap. Thus, after the Velcro fasteners are mounted on the size adjustment strap 14, and the cooperating Velcro fastener portions are mounted proximate the edge 32 of the attachment member 30 and registered with the fastener portions on the size adjustment strap, the attachment member 30 is secured proximate the inner surface of the cap such that the perimeter of the attachment member 30 overlays the perimeter 34 of the cap cover proximate opening 34, thereby covering the opening 26 with a thin film that prevents hair from protruding therethrough.

An alternate embodiment for securing the attachment member 30 to the size adjustment strap 14 is illustrated in FIG. 4. In this embodiment, a pair of clips 44A and 44B are mounted proximate the lower edge 36 of the attachment member 30 at spaced locations. These clips 44A and 44B are dimensioned for receiving the size adjustment strap 14 in the U-shaped portions of the clips. In this manner, the attachment member 30 can be mounted on the size adjustment strap 14 such that the opening 26 is covered. It will be noted that the attachment member 30 is again positioned inside the head cover 16.

Figure 5:
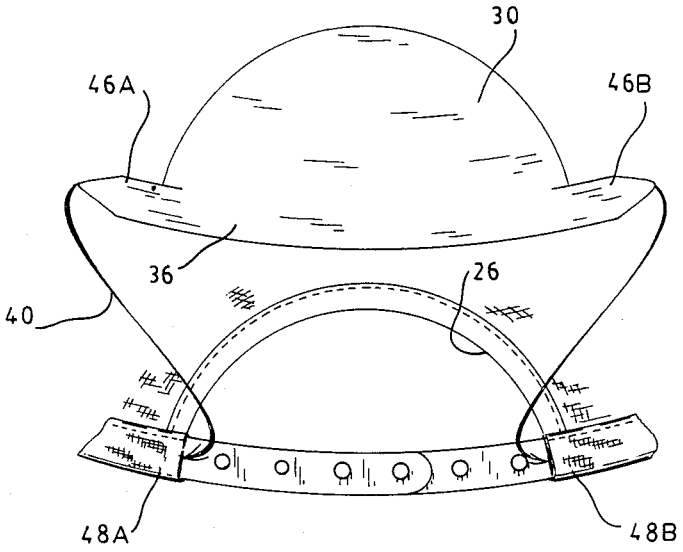
FIG. 5 illustrates a further embodiment of an attachment having alternate means for mounting the attachment.

Yet another embodiment of securing means for mounting the attachment member 30 onto the cap 12 is shown in FIG. 5. In this embodiment, the securing means 40 comprises protruding members 46A and 46B which extend outwardly from the attachment member 30 proximate the lower edge 36. These protruding members 46A and 46B are designed for being inserted into the binding 48A and 48B defined in the head cover 18 proximate the head band 20. This binding 48A and 48B is of conventional design and serves as the location to which the opposite end portions of the adjustable strap 14 are secured into the head cover 18 proximate the head band 20.

FIG. 5 shown the inside of the head cover 18 looking outwardly. It will be noted that the protruding members 46A and 46B are inserted into the binding 48A and 48B, respectively, as indicated by the illustrated arrows. Insertion of these protruding members 46A and 46B into the binding 48A and 48B serves to position the attachment member 30 such that it covers the opening 26. Further, it will be noted that the protruding members 46A and 46B can be integrally formed with the attachment member 30.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. An attachment for a conventional baseball-type cap having a size adjustment strap secured at its opposite ends to the lower border of the head cover proximate a head band, and having an opening in the back of the headcover between the head cover and the size adjustment strap, comprising:

an attachment member dimensioned for covering said opening; and securing means for releasably mounting said attachment member on said cap such that said attachment member covers said opening and prevents hair from protruding through said opening when said cap is worn.

2. The attachment for a cap of claim 1 wherein said attachment member comprises a thin film having a semi-circular outline.

3. The attachment of claim 1 wherein said attachment member has a semi-circular outline, and comprises a thin film plastic which is transparent.

4. The attachment for a cap of claim 1 wherein said securing means comprises hook and pile fasteners which join said attachment member to said cap.

5. The attachment for cap of claim 1 wherein said securing means comprises clips which secure said attachment member to said cap.

6. The attachment for a cap of claim 1 wherein said securing means comprises a pair of protruding members integrally formed with said attachment member, said protruding members being designed for mechanically engaging said cap to hold said attachment member in position for covering said opening.

7. The attachment for a cap of claim 1 wherein said securing means serves to mount said attachment member on said size adjustment strap.

* * * * *